US009584892B2

(12) United States Patent
Berkman et al.

(10) Patent No.: US 9,584,892 B2
(45) Date of Patent: Feb. 28, 2017

(54) SPEAKER AND SHOWERHEAD ASSEMBLY

(71) Applicant: Homewerks Worldwide, LLC, Lincolnshire, IL (US)

(72) Inventors: Peter D. Berkman, Highland Park, IL (US); Vincent Linden, Algonquin, IL (US); Michael Malaker, Gurnee, IL (US); David Pehar, Willoughby, OH (US)

(73) Assignee: Homewerks Worldwide, LLC, Lincolnshire, IL (US)

( * ) Notice: Subject to any disclaimer, the term of this patent is extended or adjusted under 35 U.S.C. 154(b) by 15 days.

(21) Appl. No.: 14/723,846

(22) Filed: May 28, 2015

(65) Prior Publication Data

US 2016/0353187 A1 Dec. 1, 2016

(51) Int. Cl.

| | |
|---|---|
| ***H04R 5/02*** | (2006.01) |
| ***H04R 1/02*** | (2006.01) |
| ***B05B 1/18*** | (2006.01) |

(52) U.S. Cl.

CPC ..... *H04R 1/028* (2013.01); *B05B 1/18* (2013.01); *H04R 5/02* (2013.01); *H04R 2420/07* (2013.01)

(58) Field of Classification Search

CPC ..... B05B 1/18; H04R 2420/07; H04R 5/02; H04R 1/028

See application file for complete search history.

(56) References Cited

U.S. PATENT DOCUMENTS

| | | | |
|---|---|---|---|
| 2,189,008 | A | 2/1940 | Kurth |
| 2,359,021 | A | 9/1944 | Campbell et al. |
| 3,701,895 | A | 10/1972 | Sweetser |
| 3,832,679 | A | 8/1974 | Foley et al. |
| 4,142,227 | A | 2/1979 | Aikens |
| 4,681,024 | A | 7/1987 | Ivey |
| 4,814,961 | A | 3/1989 | O'Brien et al. |
| 5,068,773 | A | 11/1991 | Toth |
| 5,278,432 | A | 1/1994 | Ignatius et al. |
| 5,628,558 | A | 5/1997 | Iacono et al. |
| 5,909,534 | A | 6/1999 | Ko |
| 6,060,979 | A | 5/2000 | Eichsteadt |
| 6,087,938 | A | 7/2000 | Gitelis et al. |
| 6,345,685 | B1 | 2/2002 | Wells et al. |
| 6,494,599 | B1 | 12/2002 | Leen |
| 6,558,003 | B2 | 5/2003 | Mihara |
| 6,634,768 | B2 | 10/2003 | McKenzie et al. |
| 6,769,509 | B2 | 8/2004 | Harwood |
| 7,066,613 | B2 | 6/2006 | Vishwamitra |
| 8,382,332 | B2 | 2/2013 | Zakula et al. |
| 8,485,696 | B2 | 7/2013 | Pringle et al. |

(Continued)

OTHER PUBLICATIONS

Wong, George, "iShower brings music to your bathroom" retrieved from http://www.ubergizmo.com/2012/01/ishower/ on Jul. 19, 2015.

(Continued)

*Primary Examiner* — Muhammad N Edun

(74) *Attorney, Agent, or Firm* — Cozen O'Connor

(57) ABSTRACT

A speaker assembly is disclosed as having a shower device, a housing having openings through which sound may travel, and two speakers contained in the housing that project sound through the openings. The housing defines a recess that may be connected to the shower device. The speakers may be wirelessly connected to an external audio source and may be controlled by a wireless remote.

19 Claims, 15 Drawing Sheets

(56) References Cited

U.S. PATENT DOCUMENTS

| | | | | |
|---|---|---|---|---|
| 8,763,750 | B1 | 7/2014 | Berkman et al. | |
| D715,902 | S | 10/2014 | Malaker et al. | |
| D717,408 | S | 11/2014 | Malaker | |
| 8,967,832 | B2 | 3/2015 | Zakula et al. | |
| 9,004,723 | B2 | 4/2015 | Zakula et al. | |
| 2004/0179710 | A1 | 9/2004 | Farinelli et al. | |
| 2006/0072776 | A1 | 4/2006 | Vishwamitra | |
| 2013/0062437 | A1 | 3/2013 | Hanna et al. | |
| 2014/0177900 | A1 | 6/2014 | Berkman et al. | |
| 2014/0183279 | A1* | 7/2014 | Hanna | B05B 1/18 239/289 |
| 2014/0254857 | A1 | 9/2014 | Berkman et al. | |
| 2014/0360805 | A1 | 12/2014 | Berkman et al. | |
| 2015/0271583 | A1* | 9/2015 | Wan | B05B 1/185 239/289 |

OTHER PUBLICATIONS

"Kohler Moxie Showerhed + Wireless Speaker" retrieved from http://www.us.kohler.com/us/Bathroom-New-Products-Moxie%E2%84%A2-Showerhead-+-Wireless-Speaker/content/CNT16200089.htm on Apr. 15, 2015.

* cited by examiner

SPEAKER AND SHOWERHEAD ASSEMBLY

FIELD OF THE INVENTION

The invention relates generally to audio systems, and more particularly to speaker assemblies containing a shower device.

BACKGROUND

Numerous types of speaker assemblies are available for providing music and other audio content in homes, businesses, and other settings. Known speaker systems that are well-suited for use in certain areas can be unsuitable for use in other areas due to a wide variety of factors, such as, for example, space limitations, lack of convenient access to a source of electrical power, potential exposure to high humidity, difficulties associated with mounting the speakers, or esthetic issues with power cords and/or connecting cords that transmit audio signals to the speakers.

Use of Bluetooth technology and other wireless technology can eliminate the need for wired connections to transmit audio signals, but the audio quality may suffer in areas where electronic interference may be present. From the standpoint of the listener, audio quality can also be affected significantly by factors such as speaker placement, obstacles or lack of obstacles between the listener and the speaker, acoustics of the room in which the speakers are placed, background noise, and speaker volume or loudness.

One of the more difficult challenges in providing high-quality audio in homes, businesses, and other settings relates to provision of music and other audio content in bathrooms, where factors such as acoustics, fan noise, shower noise, moisture and humidity can be particularly problematic. There is a need for improvements in sound systems that can address the problems associated with these factors, and in methods of manufacturing and installing such systems.

Figure 1A:
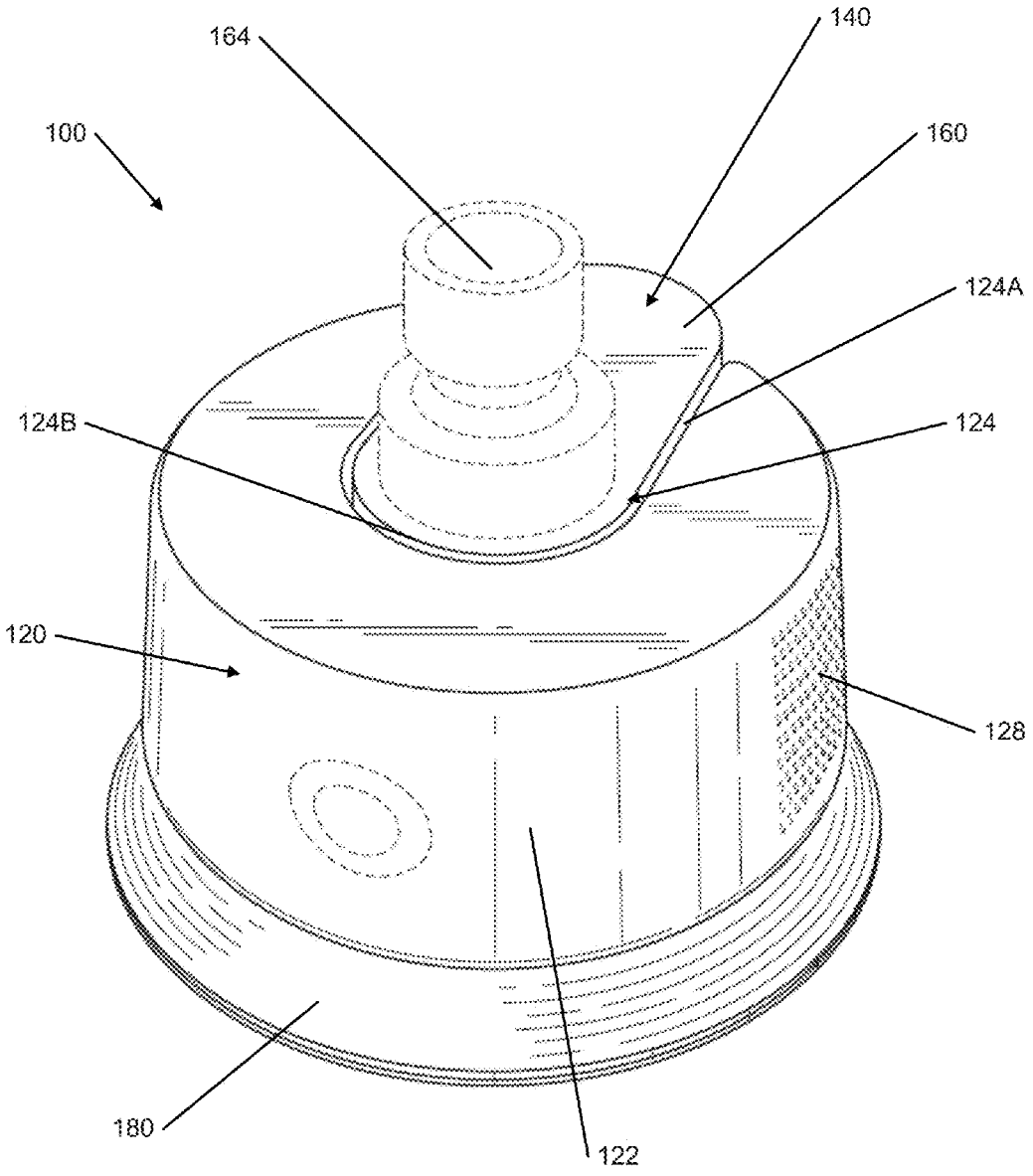
FIG. 1A is a side perspective view of an exemplary speaker assembly according to exemplary aspects of this invention.
Figure 1B:
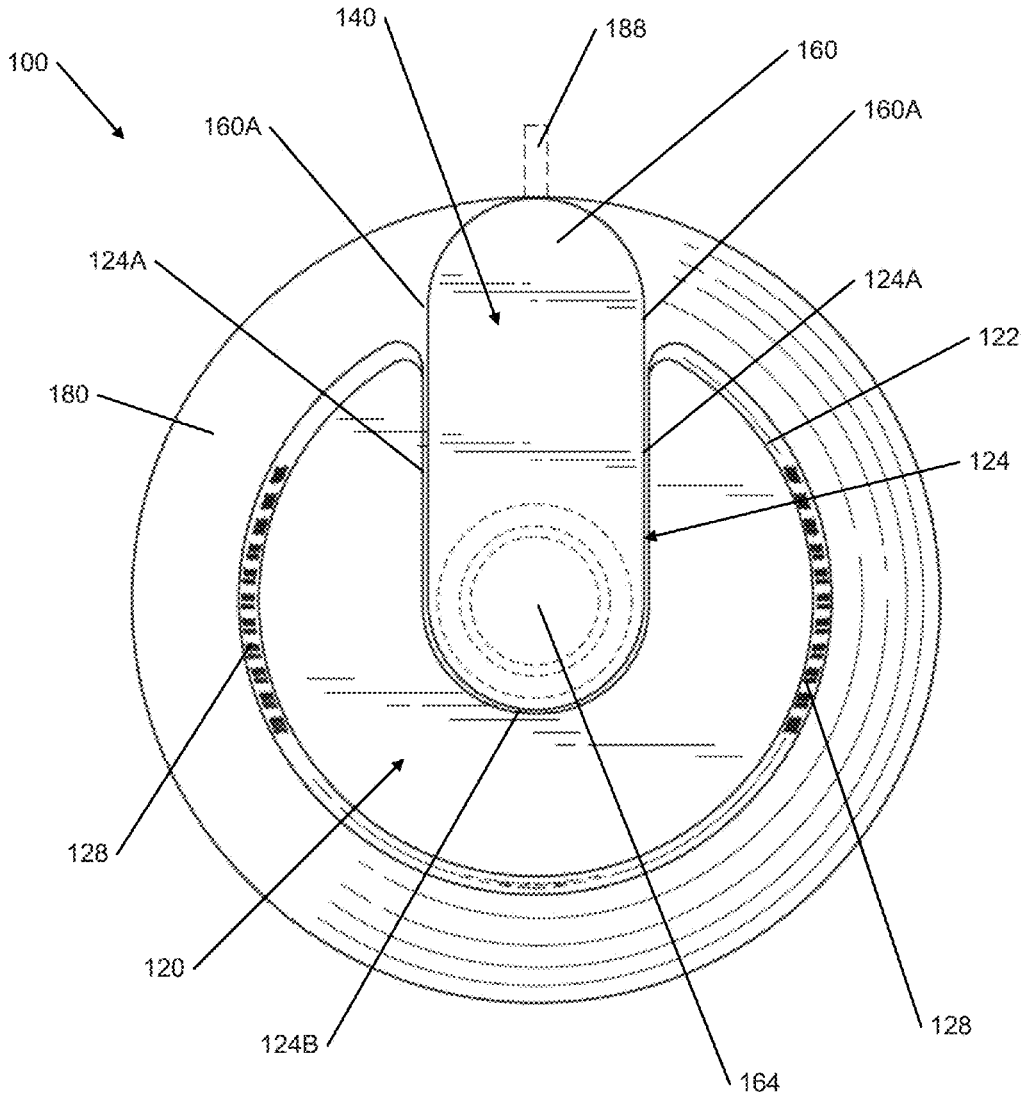
FIG. 1B is a top view of the speaker assembly illustrated in FIG. 1A according to exemplary aspects of this invention.
Figure 1C:
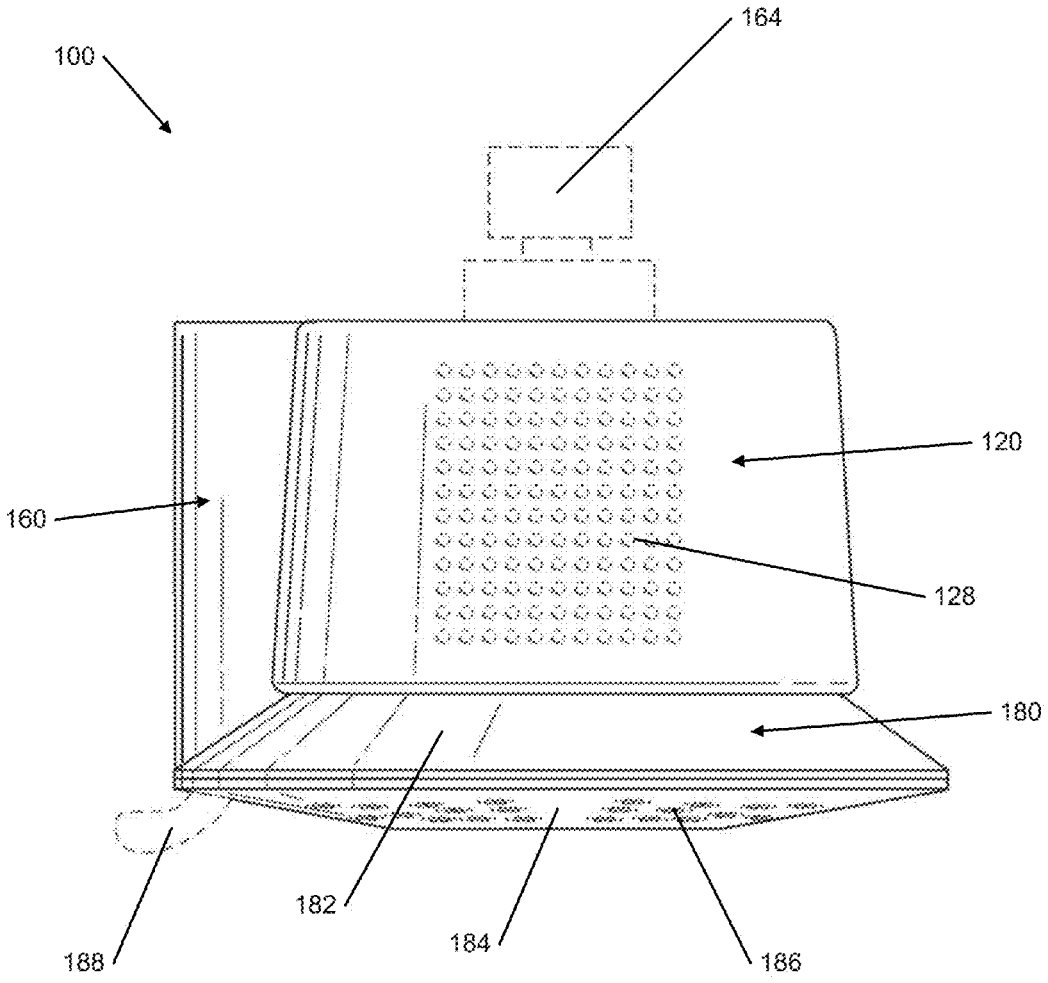
FIG. 1C is a side view of the speaker assembly illustrated in FIG. 1A according to exemplary aspects of this invention.
Figure 1D:
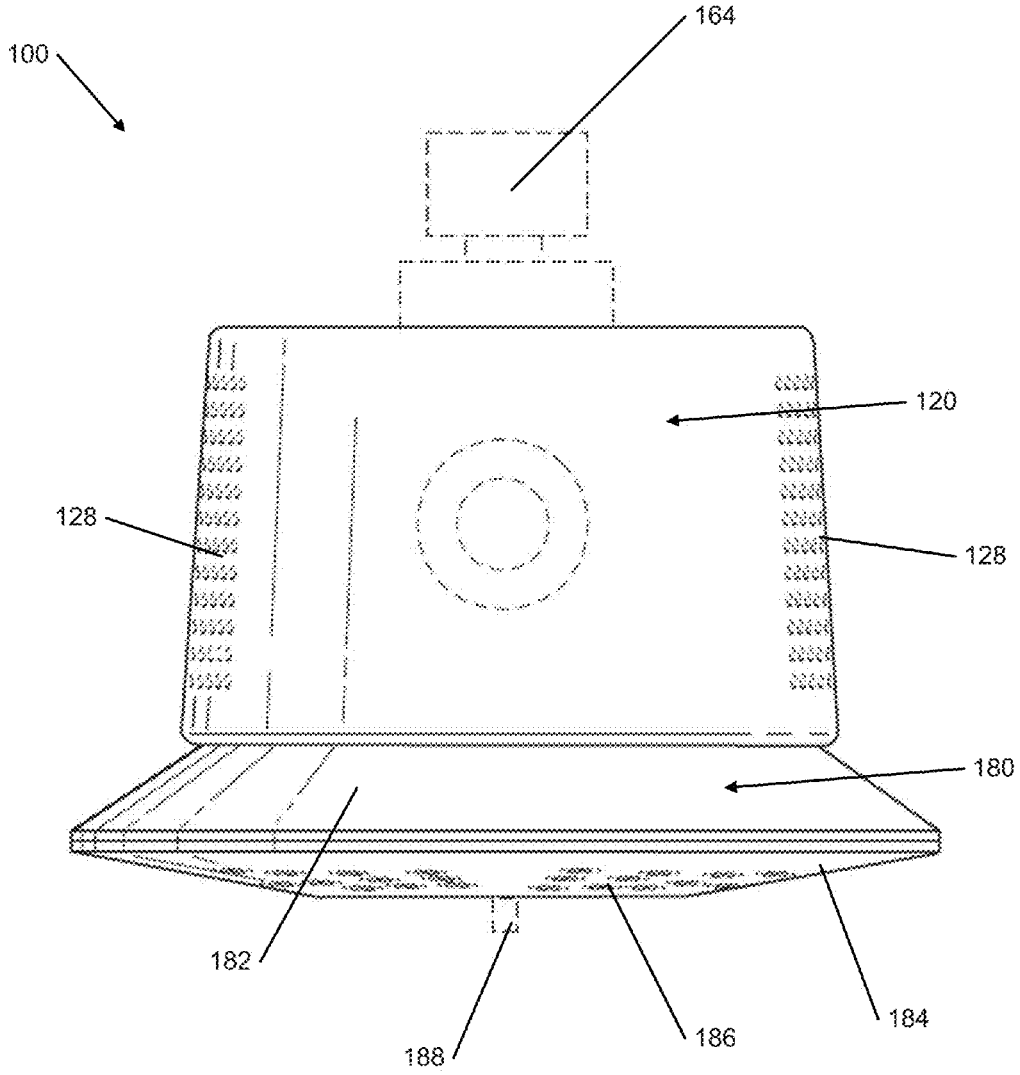
FIG. 1D is another side view of the speaker assembly illustrated in FIG. 1A according to exemplary aspects of this invention.

Corresponding reference characters indicate corresponding components throughout the several views of the drawings. Elements in the figures are illustrated for simplicity and clarity and have not necessarily been drawn to scale. For example, the dimensions of some of the elements in the figures may be exaggerated relative to other elements to help to improve understanding of various embodiments. Also, common but well-understood elements that are useful or necessary in a commercially feasible embodiment are often not depicted in order to facilitate a less obstructed view of the illustrated elements.

SUMMARY

In an independent aspect, a speaker assembly may generally include a shower device and housing. The housing may include an inner face and an outer face. The inner face may generally define a recess. The recess may receive at least a portion of the shower device. The housing may contain speakers. The speakers may output sound through a plurality of openings in the outer face.

In another independent aspect, a speaker assembly may generally include a shower device and housing. The housing may generally include two speakers, and have an outer face including a plurality of openings. The speakers may output sound through at least some of the plurality of openings. The speaker assembly may define a recess that receives at least a portion of the shower device.

In yet another independent aspect, a speaker assembly may generally include a shower device and housing. The housing may include an inner face and an outer face, where the outer face defines a plurality of openings. The inner face may generally define a recess that receives at least a portion of the shower device.

In a further independent aspect, a speaker assembly may include a shower device and housing. The housing may further contain two speakers coupled to an interior side of the housing. The housing may generally define an inner face and an outer face, with the inner face further defining a recess. The two speakers may be wirelessly connected to an external audio source.

In another independent aspect, a speaker assembly may include a shower device and housing. The housing may contain two speakers. The housing may include an inner face and an outer face. The inner face may further define a recess. The recess may be defined by two straight parallel walls connected with a circular wall. The recess may receive a portion of the shower device.

DETAILED DESCRIPTION OF EMBODIMENTS

The following description is not to be taken in a limiting sense, but is made merely for the purpose of describing exemplary embodiments. Reference throughout this specification to "one embodiment", "an embodiment", "some embodiments", "one form", or similar language means that a particular feature, structure, or characteristic described in connection with the embodiment is included in at least one embodiment of the present invention. Thus, appearances of the phrases "in one embodiment," "in an embodiment," "some embodiments", "in one form", "in another form", and similar language throughout this specification may refer to the same embodiment and/or may refer to separate or alternate embodiments as well. Furthermore, the described features, structures, or characteristics of the invention may be combined in any suitable manner in one or more embodiments.

FIGS. 1A-1D illustrates a shower speaker assembly 100 which includes a shower device 140 and a speaker housing 120. The shower device 140 may be coupled to or engaged with the speaker housing 120 to create the shower speaker assembly 100.

The speaker housing 120 may include an outer face 122 and an inner face 124. The outer face 122 may be generally circular in shape. The housing outer face 122 may include a plurality of openings 128 which are connected to the speaker system. The described embodiment envisions two sets of openings 128, generally directed in opposite directions from each other. The sets of openings 128 may generally define a rectangular shape. In alternative embodiments the plurality of openings 128 may generally define different shapes and may not be limited to two sets of openings 128. The set of openings 128 may provide a means for the sound to propagate outward from the speaker system to provide sound to the user of the shower speaker assembly 100.

The inner face 124 may include a recess 126. This recess 126 may generally be circular in shape. The recess 126 may be defined by the inner face 124 having two parallel sides 124A connected with a circular end portion 124B. The two parallel sides 124A with the circular end portion 124B may define a U-shaped recess 126. The inner face 124 may be understood to generally define a U-shaped recess 126 as shown in the illustrated embodiment.

In alternative forms, it should be understood that the recess 126 may be provided in similar shapes and sizes. In the embodiment illustrated in FIGS. 1A-1D, the recess 126 is defined as generally circular and U-shaped. However, the two parallel sides 124A of the inner face 124 may be connected by another straight side, generally defining a rectangular recess 126. The size and shape of the recess 126 may be any configuration that is able to receive a portion of the shower device 140.

The speaker housing 120 may be made of any plastic, metal, or other materials by those known and skilled in the art. The speaker housing 120 may include other materials to maintain a waterproof or water-resistant housing, such as epoxy, o-rings, or other similar materials.

The shower device 140 as illustrated in FIGS. 1A-1D may include a top portion 160 and a bottom portion 180. FIGS. 2A-2D also illustrate the shower device 140 individually in greater detail. Generally, the top portion 160 may include the water connection and the bottom portion 180 may be utilized to spray the water out of the shower device. The top portion 160 may be sized and shaped to be received within the recess 126 of the speaker housing 120. The top portion 160 may generally be circular in shape. The top portion 160 may be generally oval in shape without departing from this invention. The top portion 160 may be defined by two parallel sides 160A connected with a circular end portion 160B. The two parallel sides 160A with the circular end portion 160B may define a U-shape. In alternative forms, it should be understood that the top portion 160 may be provided in similar shapes and sizes. In the embodiment illustrated in FIGS. 1A-1D, the top portion 160 is defined as generally circular and U-shaped. However, the two parallel sides 160A of the top portion 160 may be connected by another straight side, generally defining a rectangular top portion 160. The size and shape of the top portion 160 may be any configuration that is able to fit into the recess 126 of the speaker housing 120.

As shown in FIGS. 1A-1C and 4B, the top portion 160 may generally include a waterway 162. The top portion 160 may also define an inlet 164. The inlet 164 may be utilized to connect to the water supply in the shower area. As will be understood by those of skill of the art, any connection means may be utilized at the inlet 164 to connect to the water supply for the shower connection. Generally, the inlet 164 is connected to the waterway 162 which is in communication with the bottom portion 180 of the shower device 140 to output water through the bottom portion of the shower device 140. This will be explained in more detail below.

Figure 4A:
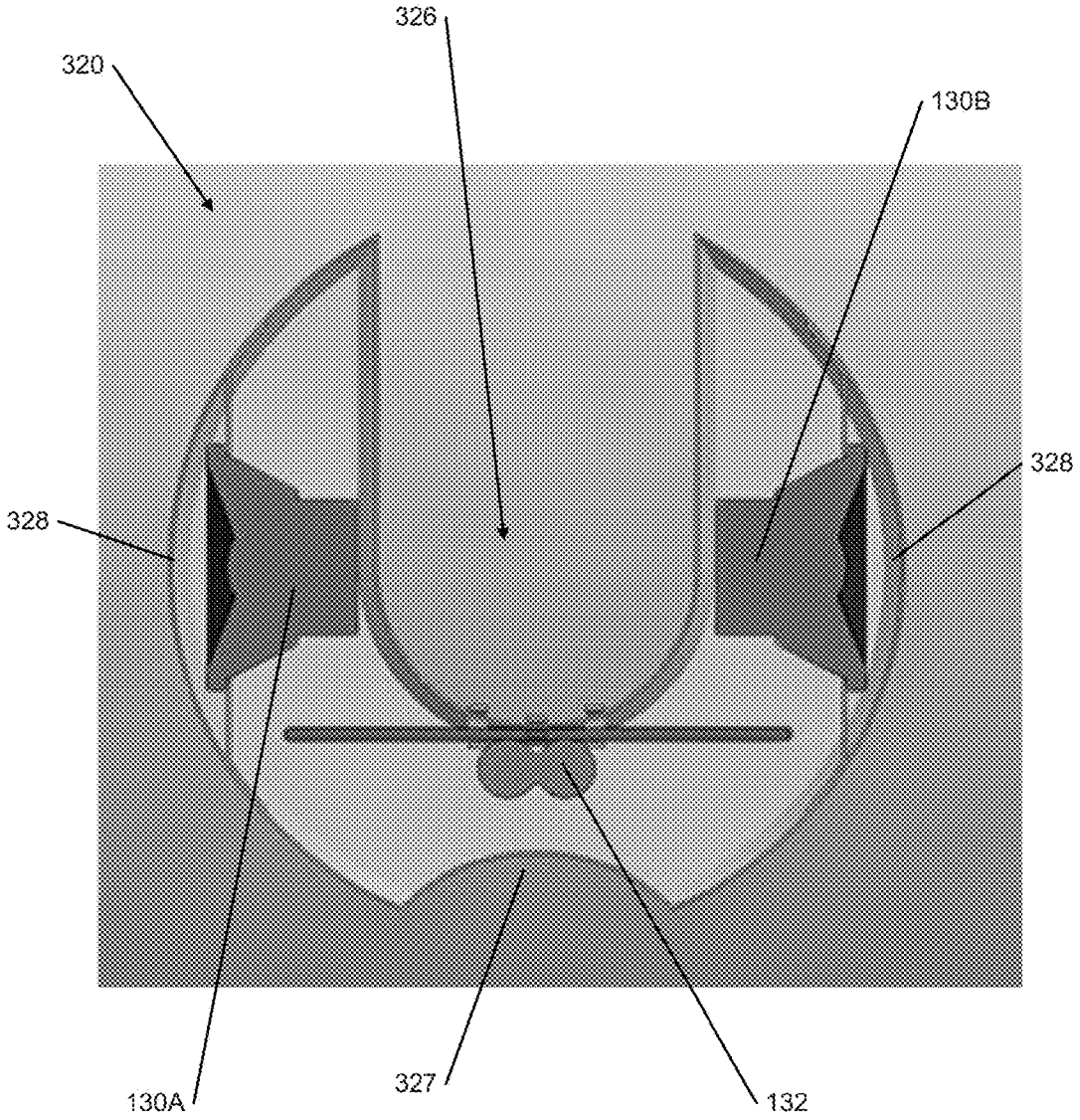
FIG. 4A is a section view of a speaker housing for use with the speaker assembly illustrated in FIG. 1A according to exemplary aspects of this invention.

The bottom portion 180 may generally include a top face 182 and a bottom face 184. As best shown in FIG. 4A, the top face 182 and the bottom face 184 may be circular in shape. In the embodiment illustrated, the bottom face 184 may be larger in diameter than the top face 182. It should be understood that the top face 182 and bottom face 184 may be defined in different shapes and are not limited to being circular in nature.

The bottom face 184 may include a plurality of openings 186. The plurality of openings 186 may be generally circular, with the openings arranged in increasingly larger concentric circles. In alternative forms, the arrangement of the openings 186 may take any form. The openings 186 may provide a water flow.

Figure 2A:
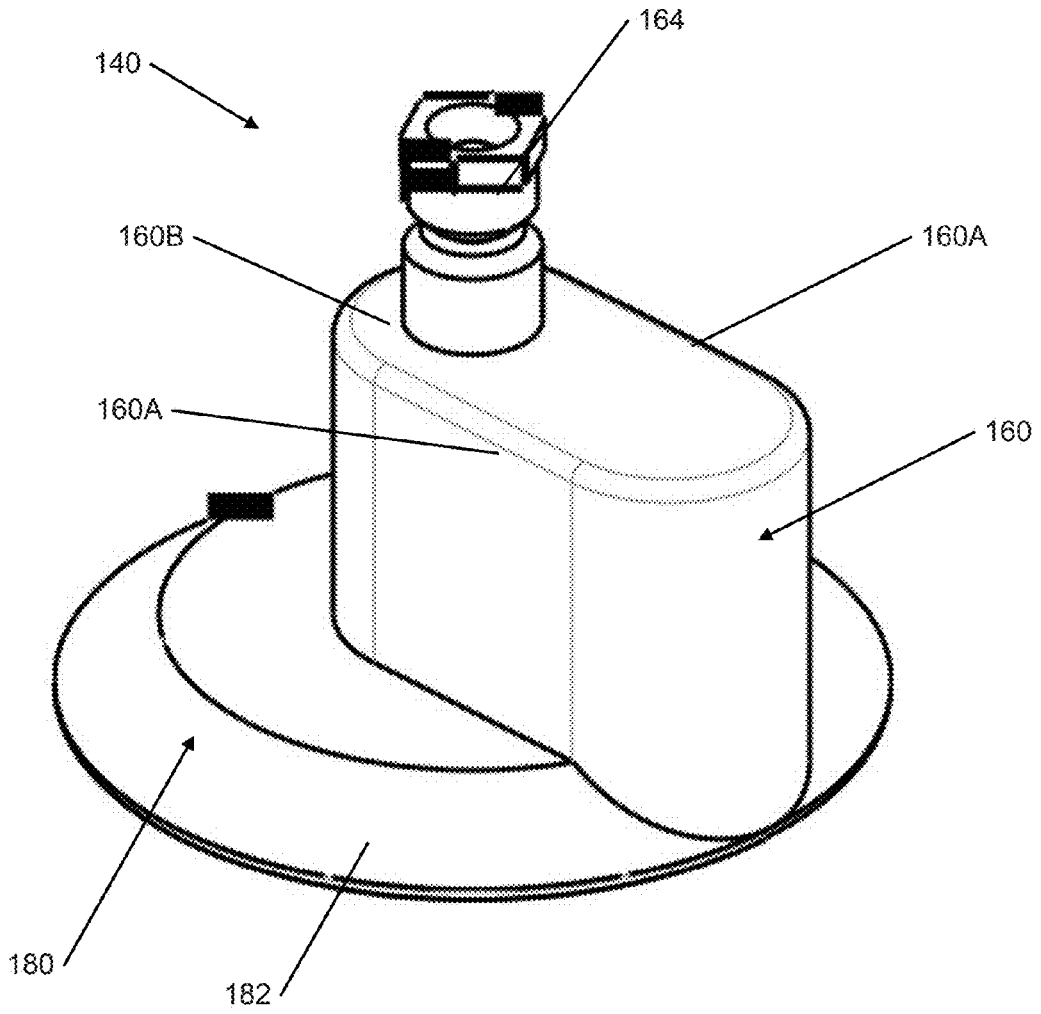
FIG. 2A is a side perspective view of an exemplary shower device for use with the speaker assembly illustrated in FIG. 1A according to exemplary aspects of this invention.
Figure 2B:
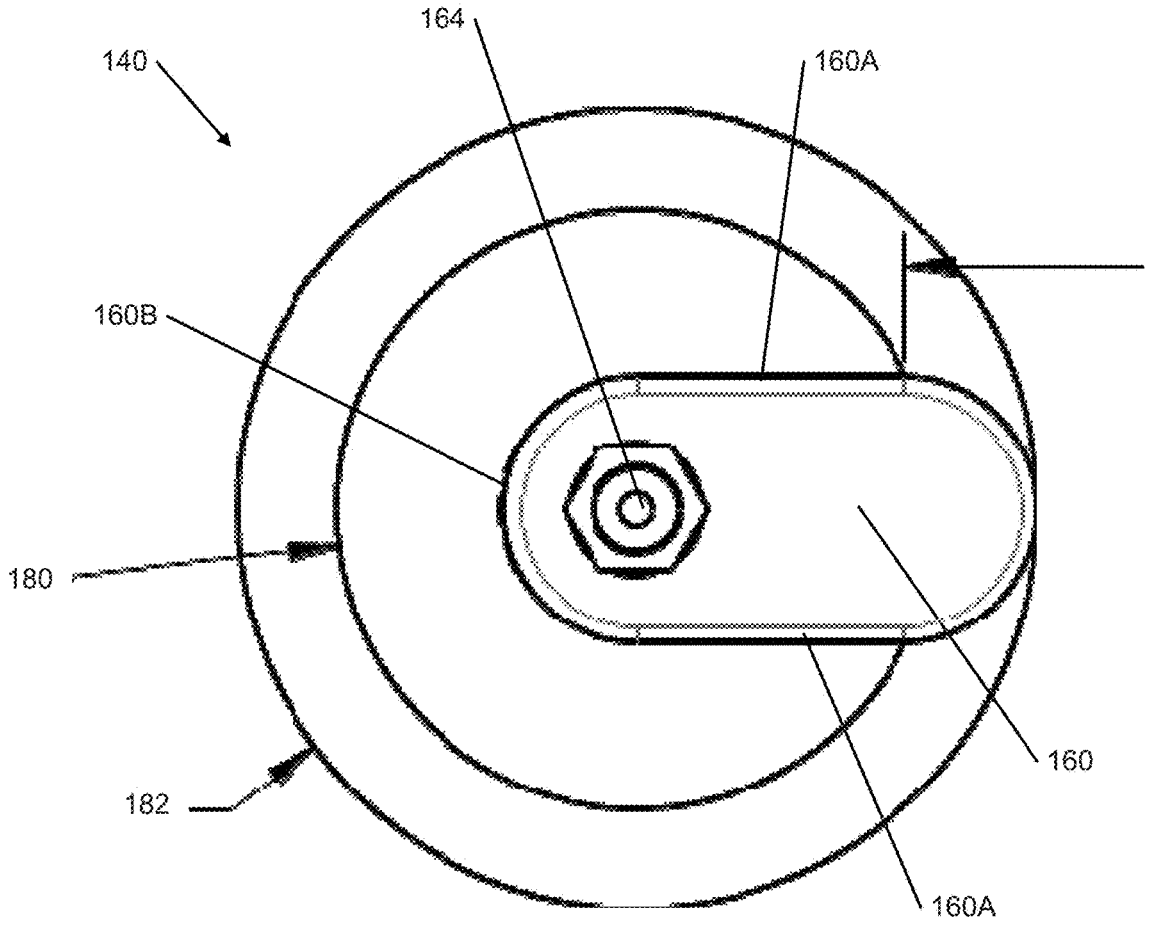
FIG. 2B is a top view of the shower device illustrated in FIG. 2A according to exemplary aspects of this invention.
Figure 2C:
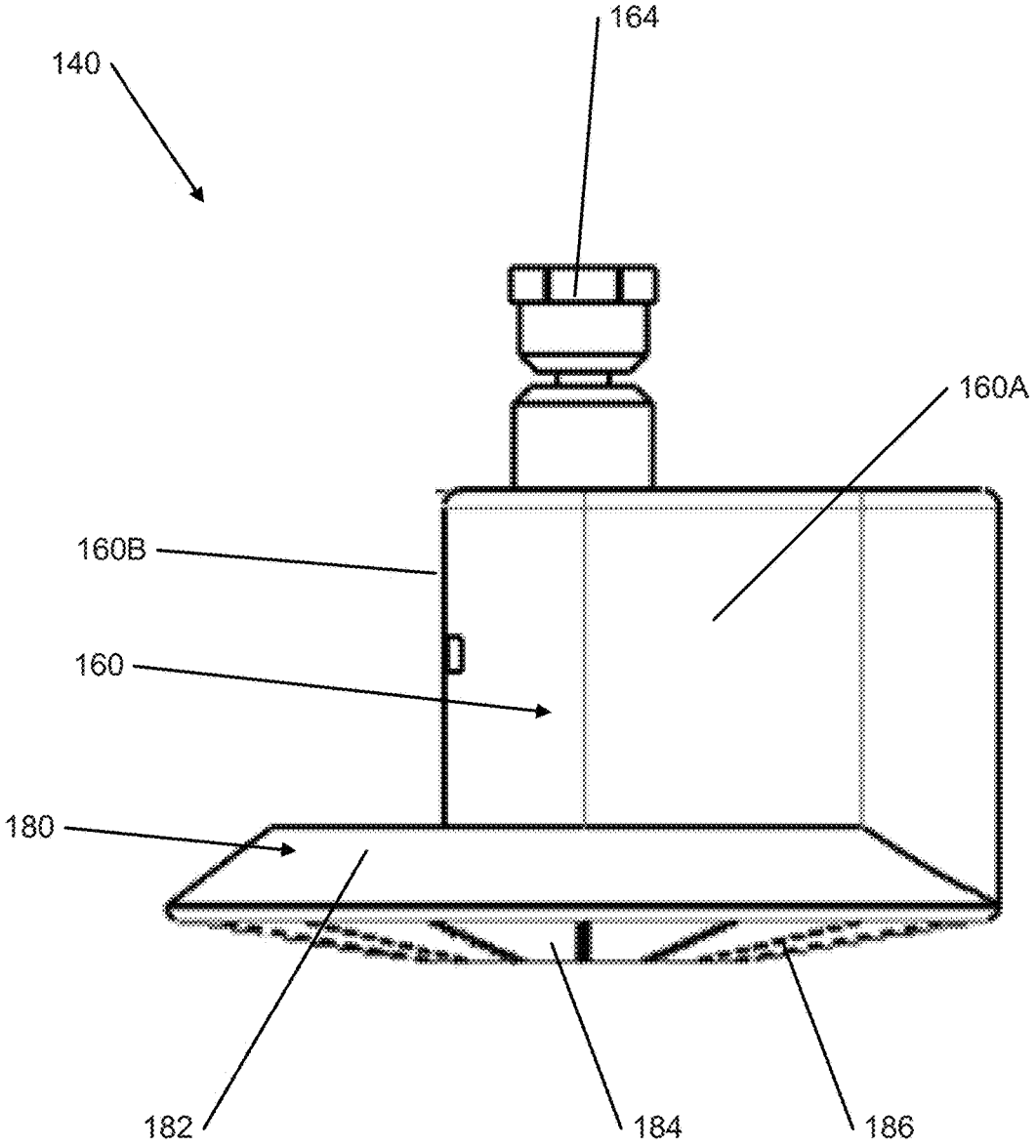
FIG. 2C is a side view of the shower device illustrated in FIG. 2A according to exemplary aspects of this invention.
Figure 2D:
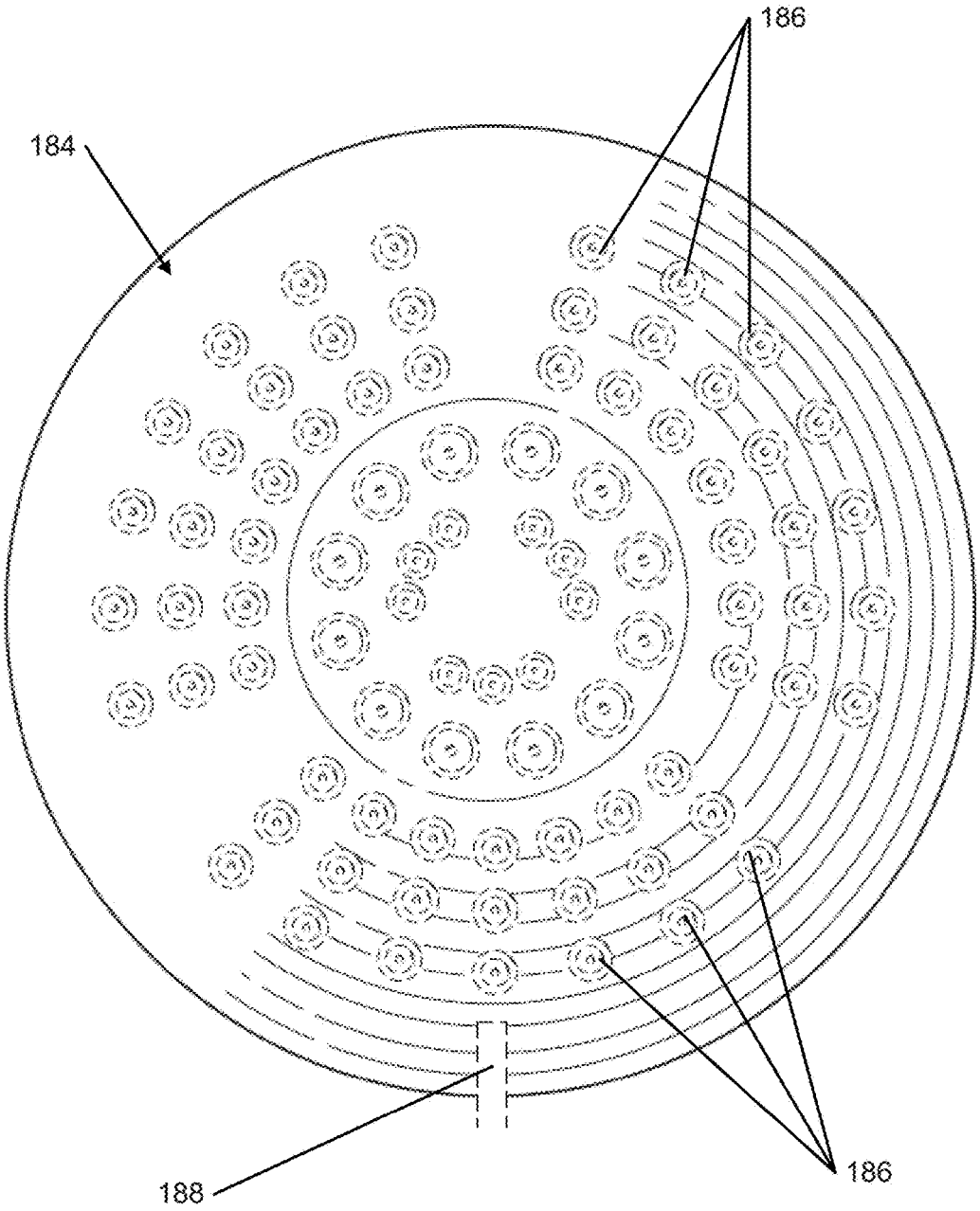
FIG. 2D is a bottom view of the shower device illustrated in FIG. 2A according to exemplary aspects of this invention.

As further detailed in FIG. 2D, the bottom face 184 of the shower device defines a plurality of openings 186. This embodiment defines a plurality of openings 186 in a generally circular design, with the openings 186 arranged in increasingly larger concentric circles. In alternative forms, the arrangement of the openings 186 may take any form. The output of the water flow may be designed to alternative between different settings, where each setting is designed to output water through a different configuration of the openings 186. It should be recognized that each setting may use any combination of openings 186 and each setting does not have to be mutually exclusive. As disclosed in the preferred embodiment, a means for changing between settings may include a switch 188.

The bottom portion 180 may also include a switch 188. The switch 188 may be located anywhere along the bottom portion 180 as to provide an easy means for manually rotating or moving the switch 188. The switch 188 may provide a means for changing between settings for the arrangement of the openings 186. The switch and the settings for the arrangement of the openings 186 may provide alternatives between different settings, where each setting is designed to output water through a different configuration of the openings 186. It should be recognized that each setting on the switch 188 may use any combination of openings 186 and each setting does not have to be mutually exclusive.

Figure 3A:
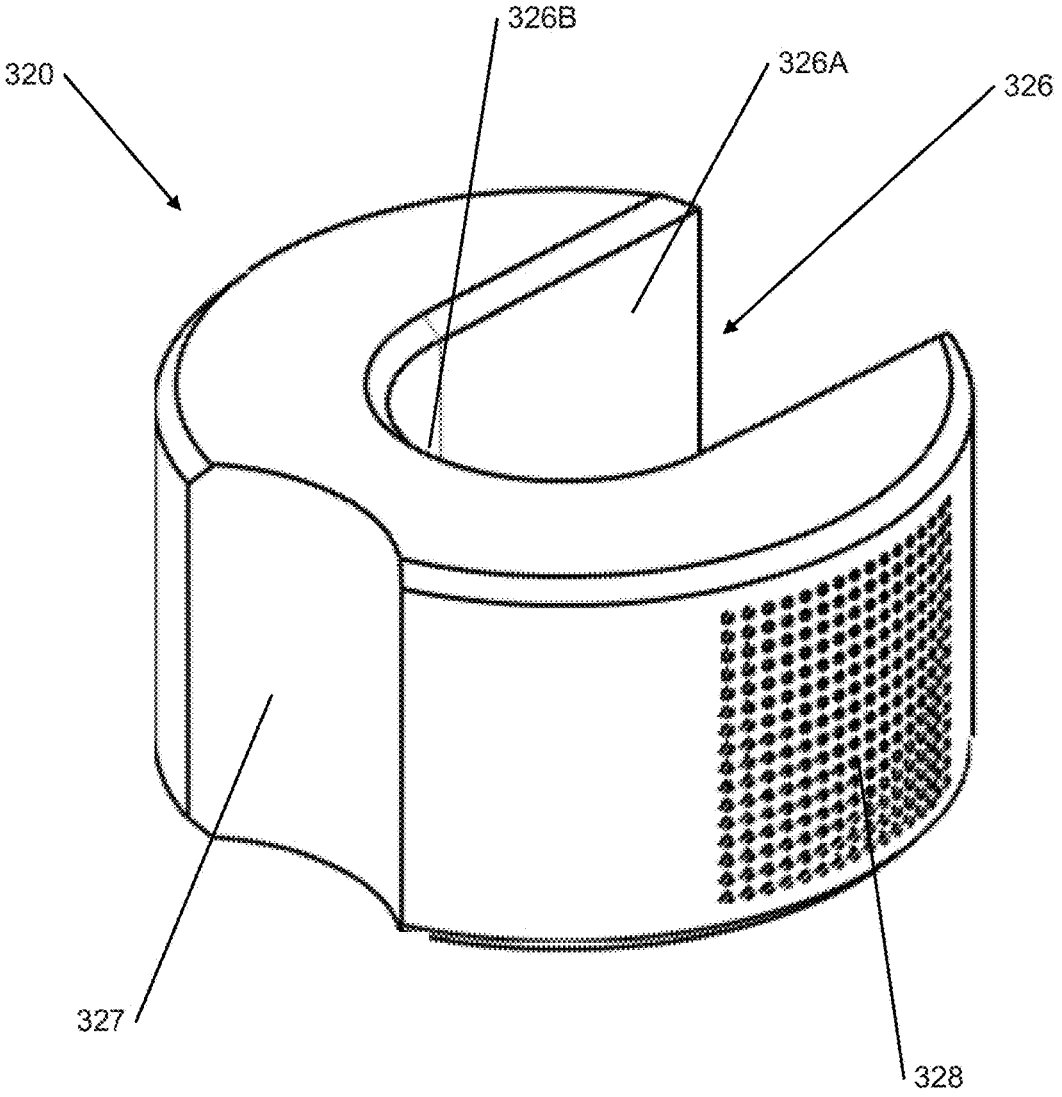
FIG. 3A is a side perspective view of an exemplary speaker housing for use with the speaker assembly illustrated in FIG. 1A according to exemplary aspects of this invention.
Figure 3B:
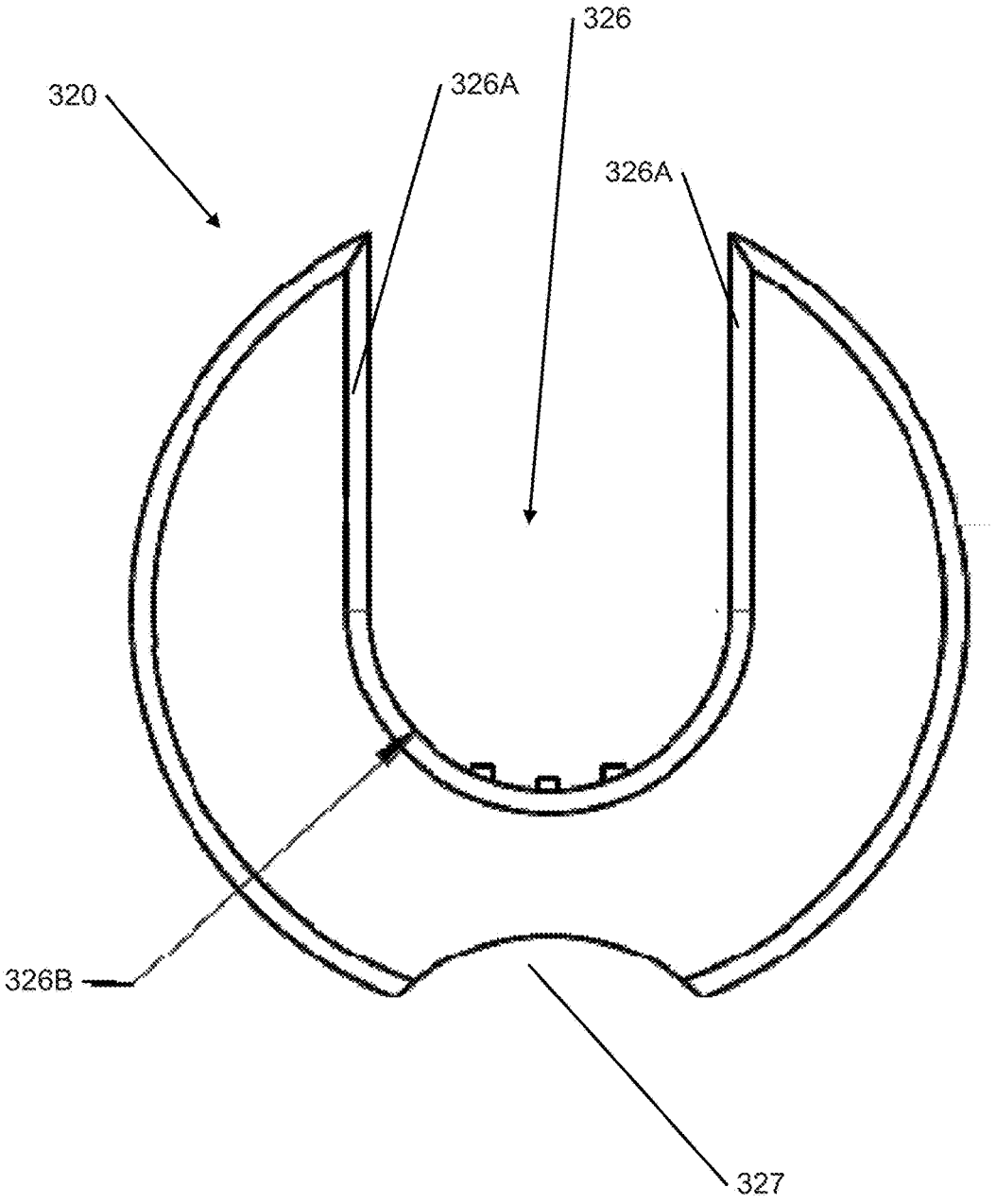
FIG. 3B is a top view of the speaker housing illustrated in FIG. 3A according to exemplary aspects of this invention.

FIGS. 3A and 3B illustrate another embodiment of a speaker housing for a speaker assembly according to the examples of this invention. For purposes of convenience, items that are similar to those discussed above with respect to FIGS. 1A-1D, will be referenced utilizing the same last two-digit number but using the prefix "3" to simply distinguish one embodiment from another. The speaker housing 320 shown in FIGS. 3A and 3B defines a first recess 326 and a second recess 327.

As was described above, the first recess 326 may be defined in an inner face of the speaker housing 320. As illustrated in FIGS. 3A and 3B, the second recess 327 may generally be defined in a circular shape. The second recess 327 is defined in the outer face of the speaker housing 320. The second recess 327 may be sized and shaped to be any configuration that is able to receive the remote assembly, as will be explained and detailed later.

In alternative forms, it should be understood that the first recess 326 and the second recess 327 may be provided in similar shapes and sizes. In the embodiment illustrated in FIGS. 3A and 3B, both recesses 326, 327 are generally curved and generally define a U-shaped recess. It should be understood that these recesses may also be rectangular, triangular, or any other shape. The first recess 326 and the second recess 327 do not have to be similar in shape.

As further illustrated in FIG. 3A, the housing 320 may include a plurality of openings 328 which are connected to the speaker system. In alternative embodiments the plurality of openings 328 may generally define different shapes and may not be limited in number to the set of openings 328. The set of openings 328 may provide a means for the sound to propagate outward from the speaker system to provide sound to the user of the shower speaker assembly 100.

Figure 4B:
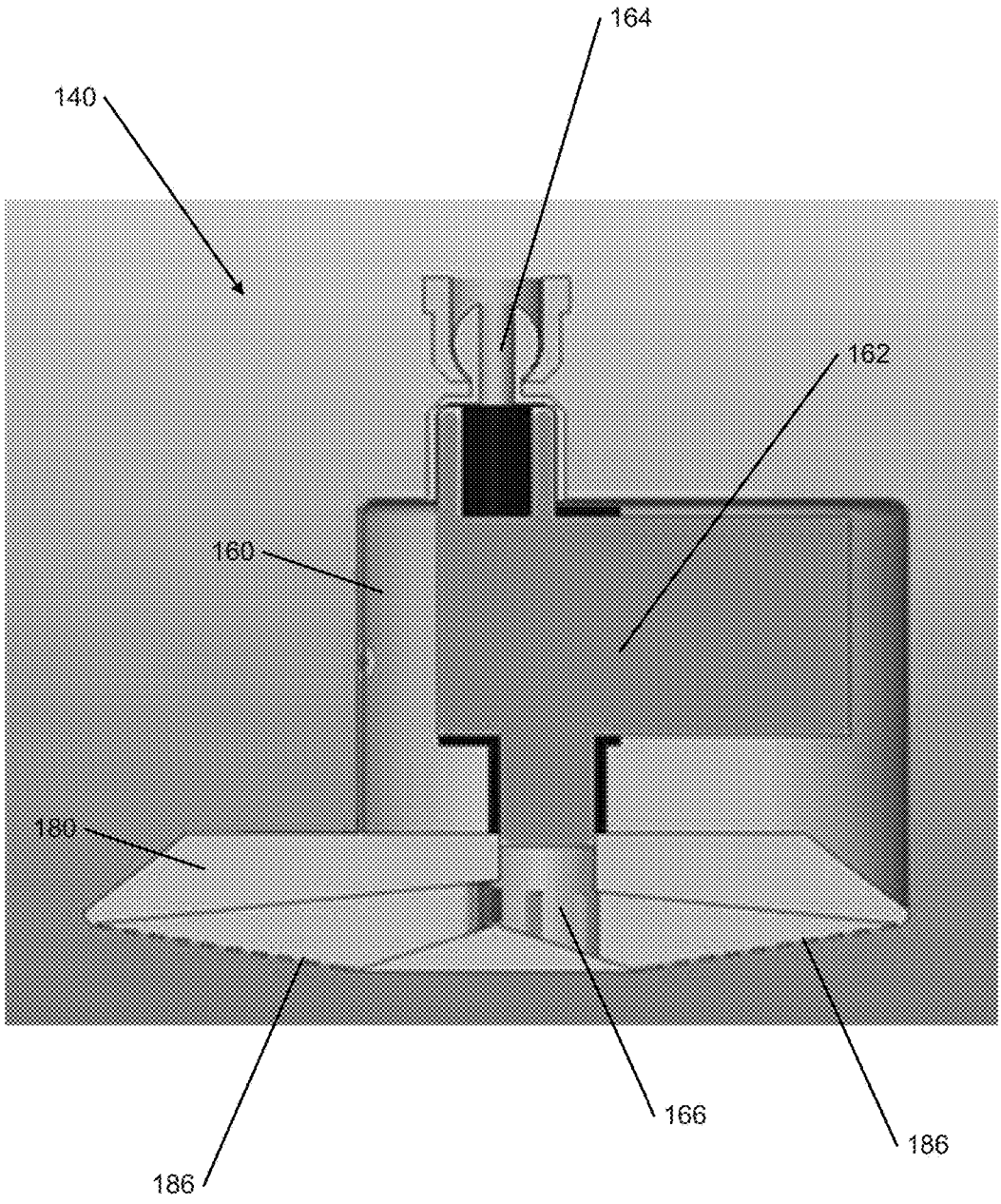
FIG. 4B is a section view of a shower device for use with the speaker assembly illustrated in FIG. 1A according to exemplary aspects of this invention.

FIG. 4A illustrates a section view of the speaker housing 120, 320 so that the internal components are visible according to exemplary aspects of this invention. FIG. 4B illustrates a section view of the shower device 140 so that the internal components are visible according to exemplary aspects of this invention.

A section view of the speaker housing 120, 320 is illustrated in FIG. 4A so that the internal components are visible. The speaker housing 120, 320 may contain a first speaker 130A and a second speaker 130B. As best shown in FIG. 4A, the speakers 130A, 130B are coupled to an interior side of the speaker housing 120, 320. This coupling between the speakers 130A, 130B and the speaker housing 120, 320 may occur through bonding, mechanical means, or other forms of coupling. Both speakers 130A, 130B may be positioned to project sound through the plurality of openings 128 on the outer face of the speaker housing 120. In this embodiment, the speakers 130*a*, 130*b* may be positioned to project sound through the openings 128 in generally opposite directions, and are positioned approximately equal distances from the recess 126 and/or the second recess 327.

In some embodiments, the speaker housing 120, 320 may contain an internal power source 132. As shown in FIG. 4A, some embodiments may have this power source as a battery 132. The internal power source 132 or battery may be a single battery or multiple individual batteries. In some embodiments the internal power source 132 or batteries may be removably-coupled to an inside wall of the speaker housing 120, 320. As illustrated in FIG. 4A, the internal power source 132 or battery may be coupled to the inside wall of the speaker housing 120, 320 facing away from the recess 126. In further embodiments the internal power source 132 may be rechargeable. In these embodiments, the speaker housing 120, 320 may be removable and may connect to an external charging station (not shown) that recharges the internal power source 132. In this embodiment the internal power source 132 may be a battery or other known rechargeable power sources.

A section view of the shower device 140 is illustrated in FIG. 4B so that the internal components are visible. As shown in FIG. 4B, the shower device 140 generally includes a waterway 162. The top portion 160 may define an inlet 164, and the bottom portion 180 may contains an outlet valve 166. The waterway 121 may communicate between the inlet 164 and the outlet valve 166, and may be configured to output water through the outlet valve 166 and through the plurality of openings 188. Generally, the inlet 164 may be utilized to connect to the water supply in the shower area. As will be understood by those of skill of the art, any connection means may be utilized at the inlet 164 to connect to the water supply for the shower connection.

Figure 5:
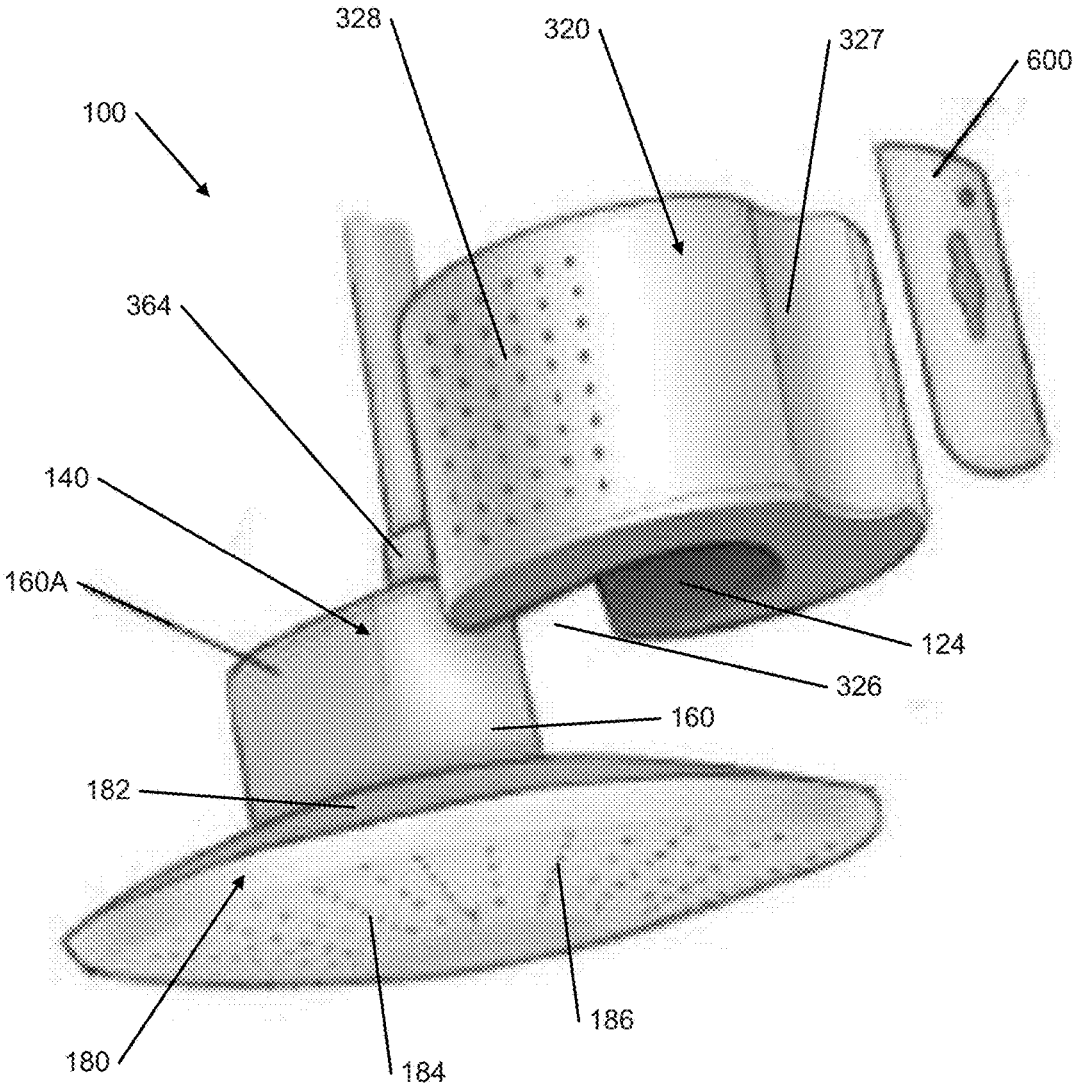
FIG. 5 is a component view of the speaker assembly illustrated in FIG. 1A according to exemplary aspects of this invention.

FIG. 5 illustrates an exemplary configuration of the shower speaker assembly 100. As shown in FIG. 5, the shower speaker assembly 100 includes the speaker housing 120 and the shower device 140. The recess 126 of the speaker housing 120 receives at least a portion of the shower device 140. In the preferred embodiment the recess 126 will receive at least a portion of the top portion 160 of the shower device 140. While the preferred embodiment illustrates the recess 126 receiving only a portion of the top portion 160, other embodiments may include the recess 126 receiving at least a portion of the bottom portion 180 of the shower device 140, and may receive portions of both the top portion 160 and the bottom portion 180.

As further illustrated in FIG. 5, when the recess 126 of the speaker housing 120 receives at least a portion of the shower device 140, the speaker housing 120 may become removably-coupled from the shower device 140. As best illustrated in FIG. 5, the recess 126 may receive a portion of the shower device 140 so that the inner face 124 of the speaker housing 120 is connected to the portion of the shower device 140 received in the recess 126. One of ordinary skill in the art would recognize that this connection may occur through magnets, mechanical means, or by any other connection means.

Figure 6A:
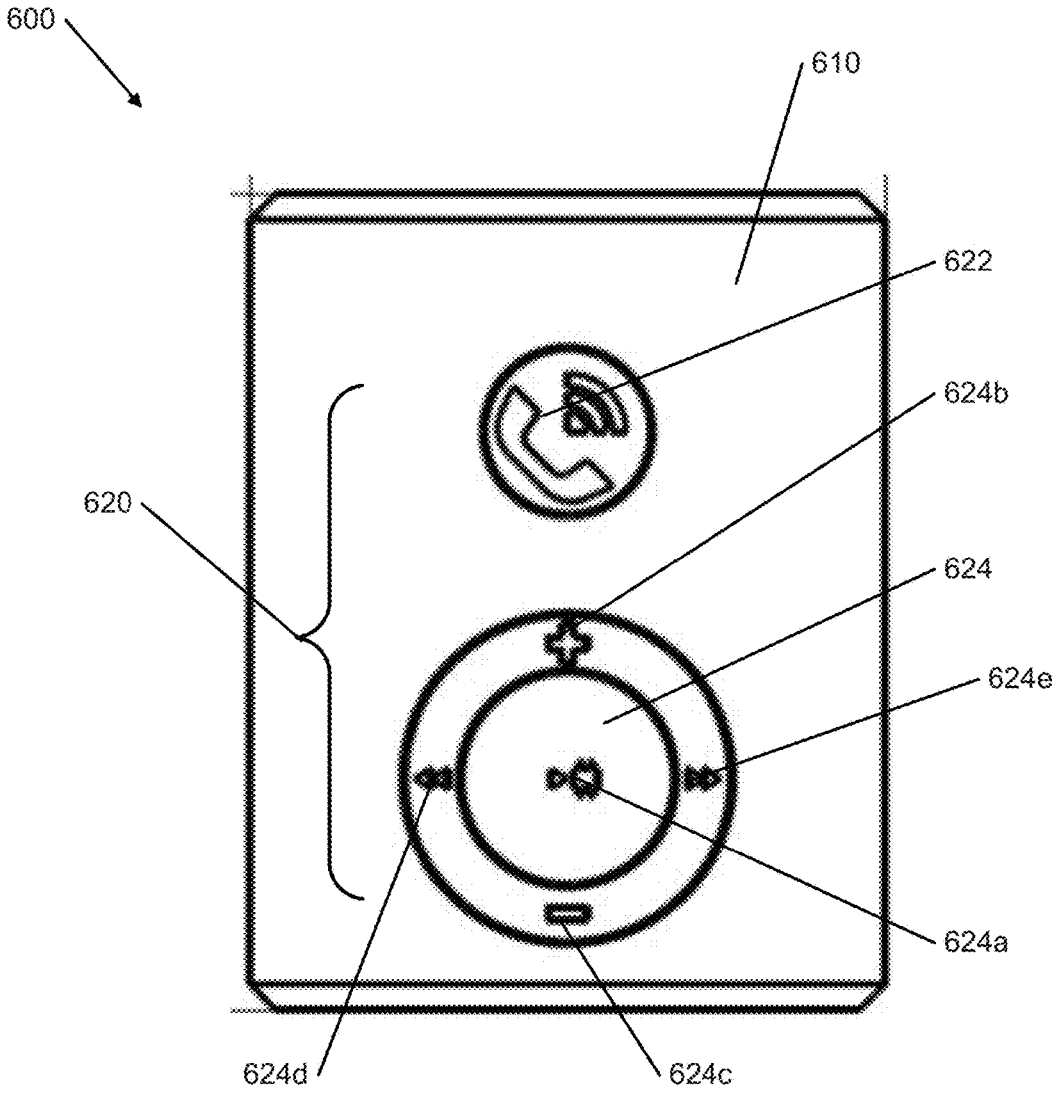
FIGS. 6A and 6B are front and perspective views of an exemplary remote control device for use with the speaker assembly illustrated in FIG. 1A according to exemplary aspects of this invention.
Figure 6B:
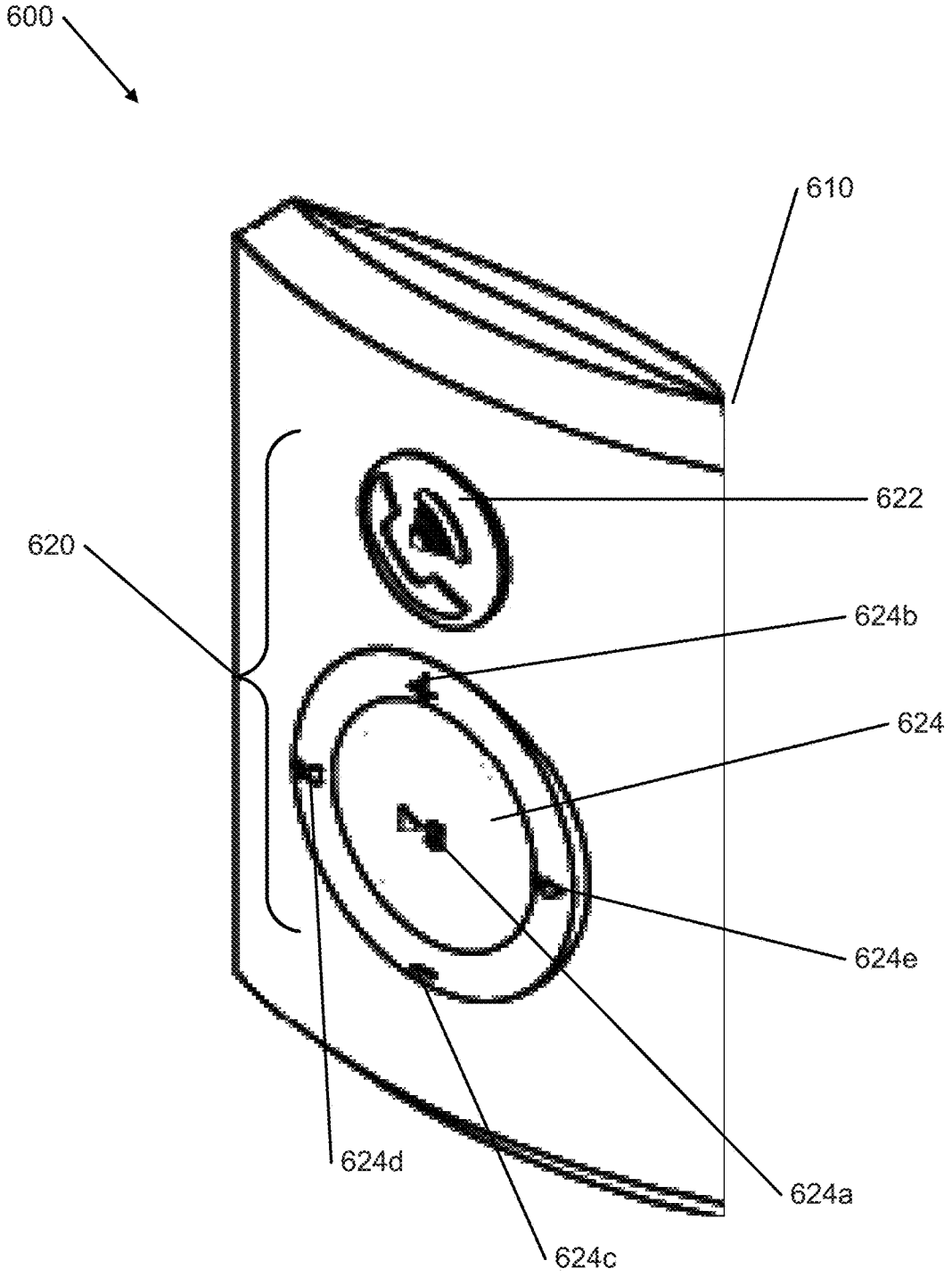

As shown in FIGS. 6A and 6B, one embodiment includes a remote control interface 600. FIGS. 6A and 6B schematically depict one implementation of a remote control device 600. In one example, the remote control device 600 may be utilized to control one or more functions of the speakers 130A, 130B described in relation to FIG. 4A. In one example, the remote control device 600 comprises a housing 610, and user interfaces 620. In a further example, the user interfaces may comprise a phone control portion 622 and a speaker control portion 624. The speaker control portion 624 may include a "pause/play" button 624*a*, "volume up/down" buttons 624*b* and 624*c*, and "forward/backward" buttons 624*d* and 624*e*, and the like. Those of ordinary skill in the art will recognize, however, that the remote control device 600 may be embodied with any combination of user input interfaces, such as interfaces 624*a*-624*e*. As described herein, the user input interfaces 624*a*-624*e* may be actuated by a user to control one or more functions of a device connected to the speakers 130A, 130B from FIG. 4A. As such, the user input interfaces 624*a*-624*e* may communicate with a connected smart phone, tablet, laptop or desktop computer, or another audio device connected to speakers 130A, 130B.

The remote control device 600 may be configured such that communication between any device is facilitated by an infrared connection, a Bluetooth connection, a Wi-Fi connection, an RF connection, or a wired connection, among others. Furthermore, the remote control device 600 may be configured with a water resistant/waterproof structure such that it may be interacted with in a wet environment (may be utilized in a shower/bath, and the like). Additionally, the remote control device 600 may comprise a suction cup structure on a back surface (not pictured) such that it may be temporarily affixed to a smooth surface (glass, stone, ceramic, metal, and the like).

As illustrated in FIG. 5, the remote control interface 600 may be received by the second recess 327 and become removably-coupled. This coupling may occur through magnets, mechanical means, or other forms of connecting means.

In another embodiment, the speakers 130A, 130B contained in the speaker housing 120 may be connected to an external audio source. In a further embodiment this connection is wireless. In different embodiments this wireless connection may be Bluetooth, a radio frequency connection, or Wi-Fi. It should be understood that any other form of wireless connection would also work.

In another embodiment, the speaker housing 120 may include a fixed button area for controlling the speakers connected to the external audio source. For example, the following functions may be controlled by a fixed button area: Volume UP, Volume DOWN, next song, previous song, power ON/OFF.

Changes may be made to the embodiments disclosed herein while still operating within the concepts contemplated. For example, parts of different size, shape, location or number may be used, and/or various parts of one embodiment may be combined with other embodiments. Similarly, in alternate embodiments different opening sizes, shapes and patterns may be used for the various parts and components of different sizes and shapes.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concepts disclosed herein.

What is claimed is:

1. A speaker assembly, comprising:

a shower device;

a housing, having an inner face and an outer face, the outer face including first and second sets of pluralities of openings and the inner face defining a first recess, wherein the first recess receives at least a portion of the shower device; and, a first speaker and a second speaker contained in the housing and coupled to an interior side thereof, the first speaker configured to output sound through the first set of plurality of openings in a first direction, and the second speaker configured to output sound through the second set of plurality of openings in a second direction, wherein the first and second directions are different.

2. The speaker assembly of claim 1, wherein the first speaker and the second speaker further comprise a wireless connection to an external audio signal source.

3. The speaker assembly of claim 2, wherein the wireless connection is a radio frequency connection.

4. The speaker assembly of claim 2, wherein the wireless connection is a Bluetooth connection.

5. The speaker assembly of claim 2, wherein the wireless connection is a Wi-Fi connection.

6. The speaker assembly of claim 1, wherein the first recess is defined in a u-shape.

7. The speaker assembly of claim 1, wherein the first recess is defined in a rectangular shape.

8. The speaker assembly of claim 1, wherein the outer face defines a second recess.

9. The speaker assembly of claim 1, further comprising a remote control interface, configured to control operation of the first and the second speaker, is further configured to be removably-coupled to the second recess.

10. The speaker assembly of claim 1, wherein the first and second directions are opposite to each other.

11. A shower and speaker assembly, comprising:

a shower device, further comprising;

a top portion and a bottom portion, wherein the bottom portion includes a top face and a bottom face;

the bottom face including a plurality of water openings;

a waterway communicating between an inlet and an outlet, wherein the inlet is located in the top portion and the outlet is located in the bottom portion and the outlet is configured to output water through at least one of the plurality of water openings in the bottom face; and, a housing, having an inner face and an outer face, the outer face including a plurality of sound openings, wherein the plurality of sound openings are oriented substantially perpendicular to the water openings, and the inner face defining a first recess, wherein the first recess receives at least a portion of the shower device; and, a first speaker and a second speaker contained in the housing configured to output stereo sound through the plurality of sound openings.

12. The shower and speaker assembly of claim 11, wherein the outer face of the housing defines a second recess.

13. The shower and speaker assembly of claim 11, wherein the first speaker and the second speaker further comprise a wireless connection to an external audio signal source.

14. The shower and speaker assembly of claim 13, wherein the wireless connection is radio frequency connection.

15. The shower and speaker assembly of claim 13, wherein the wireless connection is a Bluetooth connection.

16. The shower and speaker assembly of claim 13, wherein the wireless connection is a Wi-Fi connection.

17. The shower and speaker assembly of claim 11, wherein the first recess may be U-shaped, rectangular in shape, or another shape.

18. The shower and speaker assembly of claim 11, further comprising a remote control interface, configured to control operation of the first speaker and the second speaker, and further configured to be removably-coupled to the second recess.

19. The shower and speaker assembly of claim 11, wherein the outlet is configured to be changed between a first and a second setting, the first setting outputting water through at least a first portion of the plurality of water openings in the bottom face and the second setting outputting water through at least a second portion of the plurality of water openings in the bottom face, wherein the first portion and the second portion are not mutually exclusive.

* * * * *